United States Patent [19]

Nakao et al.

[11] 4,450,005

[45] May 22, 1984

[54] METAL REFINING METHOD

[75] Inventors: Yasuyuki Nakao; Yosuke Hoshijima, both of Himejishi; Kazuo Okohira, Kitakyusyushi, all of Japan

[73] Assignee: Nippon Steel Corporation, Tokyo, Japan

[21] Appl. No.: 345,917

[22] Filed: Feb. 4, 1982

[30] Foreign Application Priority Data

Oct. 26, 1981 [JP] Japan ..... 56-170198

[51] Int. Cl.[3] ..... C21C 5/34

[52] U.S. Cl. ..... 75/60; 75/59

[58] Field of Search ..... 75/59, 60

[56] References Cited

U.S. PATENT DOCUMENTS 3,706,549 12/1972 Knuppel ..... 75/60

*Primary Examiner*—Peter D. Rosenberg

*Attorney, Agent, or Firm*—Wenderoth, Lind & Ponack

[57] ABSTRACT

In a method of refining a metal by blowing a refining gas surrounded by a cooling gas into the melt of the metal to be refined using a concentric multi-tube system nozzle situated beneath the surface of the melt in a refining vessel, the improved metal refining method which comprises controlling the flow rate of the cooling gas passing through the passageway for the cooling gas formed between the outermost tube and the adjacent inner tube of the nozzle as defined by the following equation:

$$\frac{A(\text{Kcal}/Nl) \times B(Nl/\text{min.})}{\pi Di(\text{cm}) \times \Delta T(\text{cm})} = 600\text{–}1400(\text{Kcal/cm}^2 \cdot \text{min.})$$

wherein A is the cooling capacity of the cooling gas; B is the flow rate of the cooling gas; $\pi$Di is the inside circumference of the outermost tube; and $\Delta$T is the wall thickness of the outermost tube.

5 Claims, 6 Drawing Figures

METAL REFINING METHOD

BACKGROUND OF THE INVENTION

1. Field of the Invention

This invention relates to a method of refining a metal by blowing a refining gas surrounded by a cooling gas into the melt of the metal to be refined using a concentric multi-tube system nozzle, e.g., a concentric double tube system nozzle, situated beneath the surface of the melt in a metal refining vessel, and more particularly, the invention relates to a method of protecting the concentric multi-tube system nozzle.

2. Description of the Prior Art

In a conventional concentric double tube system nozzle (hereinafter, referred to as simply a double tube nozzle) of a metal refining vessel, mainly oxygen gas is blown into the melt to be refined from the inner tube and a cooling gas is blown into it from the outer tube of the double tube nozzle. As the cooling gas, a hydrocarbon gas such as methane or propane is mainly used in the metal refining system and as one of the improvements of such a method, there has been proposed a method which gives much better cooling effect than is attainable using $CO_2$ or steam as the cooling gas. In this improved method hydrocarbon gas is used in an amount of slightly less than 10% by weight of the amount of blowing oxygen gas as disclosed in, for example, U.S. Pat. No. 3,706,549. The technical gist of the proposed method is thus to control the amount of the cooling gas according to the amount of blowing oxygen.

However, in this method, the cooling gas used is limited to a hydrocarbon gas and it has been confirmed that when the kind of cooling gas is changed or when the dimensions of the nozzle are changed, the desired cooling effect cannot always be attained even when the amount of the cooling gas employed is adjusted to an amount of less than 10% by weight of the amount of the blowing oxygen gas.

SUMMARY OF THE INVENTION

An object of this invention is to provide an improved metal refining method using a concentric multi-tube system nozzle.

Another object of this invention is to provide a nozzle protection method wherein an excellent nozzle cooling effect can be obtained during the refining of a metal using a concentric multi-tube system nozzle regardless of the kind of the cooling gas and the dimensions of the nozzle used.

As the cooling gases employed in this invention, there can be used gases such as the hydrocarbon gases (propane, propylene, etc.), carbon dioxide and argon mentioned in the examples set forth below and also nitrogen (cooling capacity: 0.36–0.43 Kcal/Nl), carbon monoxide (cooling capacity: 0.38–0.45 Kcal/Nl), ammonia (cooling capacity: 0.6–0.65 Kcal/Nl), steam (cooling capacity: 0.47–0.57 Kcal/Nl), and mixtures of these gases. it is also possible to use an industrial furnace waste gas such as converter waste gas, blast furnace gas, coke oven gas, etc. or a combustion waste gas from an industrial furnace such as a heating furnace, a sintering furnace, etc.

As a result of their investigations into the effects of changing the kind of cooling gas or the dimensions of the double tube nozzle on the cooling effect of the nozzle, the inventors have confirmed that the desired cooling effect can be obtained by controlling the flow rate per minute of a cooling gas passed through the passageway for the cooling gas formed between the outermost tube and the inner tube of the nozzle as defined by the following equation I:

$$\frac{A(\text{Kcal/Nl}) \times B(\text{Nl/min.})}{\pi Di(\text{cm}) \times \Delta T(\text{cm})} = 600\text{–}1400\ (\text{Kcal/cm}^2 \cdot \text{min.}) \qquad \text{I}$$

wherein A is the cooling capacity of the cooling gas; B is the flow rate of the cooling gas; $\pi$Di is the inside circumference of the outermost tube; and $\Delta$T is the wall thickness of the outermost tube. BRIEF DESCRIPTION OF THE DRAWINGS FIG. 1 is a schematic sectional view showing an embodiment of a nozzle used in the method of this invention;

DESCRIPTION OF THE PREFERRED EMBODIMENTS

The invention will now be explained in detail.

The inventors investigated the effect of various different dimensions of double tube nozzles and various different cooling gases on the cooling effect of the double tube nozzle and made the following discoveries.

First, with regard to the dimensions of the nozzle, it has been confirmed that as the wall thickness of the outer tube forming the nozzle becomes thicker and/or the inside circumference of the outer tube becomes greater, it becomes more difficult to obtain a sufficient cooling effect using the same amount of cooling gas. Thus when the wall thickness of the outer tube is increased or the inside circumference of the outer tube is made longer, a larger amount of cooling gas must be used to attain the desired cooling effect.

Next, with regard to the cooling gas, it has been discovered that even when the wall thickness and inside circumference of the outer tube are the same, the flow rate of the cooling gas must be changed to obtain the same cooling effect if the kind of the cooling gas differs.

As a result of various experiments, it has been confirmed that a sufficient cooling effect can be attained while preventing the occurrence of melt loss of a concentric multi-tube nozzle situated beneath the surface of the melt by passing a cooling gas through the passageway for cooling gas in such a manner that when the circumference of the passageway for the cooling gas is represented by the inside circumference of the outermost tube of the nozzle, the heatextracting amount of the cooling gas in the cooling gas passageway (the sensitive heat and latent heat of the cooling gas) corresponds to:

$$600(\pi Di(cm) \times \Delta T(cm))Kcal/min. \text{ to } 1400(\pi Di(cm) \times \Delta T(cm))Kcal/min.$$

per minute (wherein $\pi$Di and $\Delta$T have the same significance as in equation I).

The reason for this limitation on the amount of cooling gas in the method of this invention will be explained below in detail.

Figure 1:
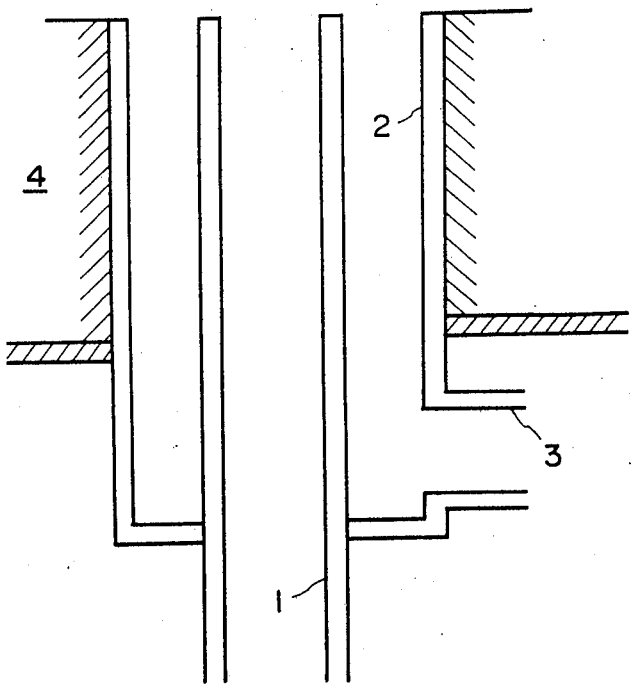

FIG. 1 is a sectional view showing the structure of a bottom-blowing double tube nozzle for the metal refining vessel (10 tons) used for obtaining the experimental data on which this invention is based. The double tube nozzle is composed of an inner tube 1 for blowing a refining gas mainly composed of oxygen and an outer tube 2. A cooling gas is introduced into the annular space between the outer tube 2 and the inner tube 1 through a conduit 3 connected to a cooling gas source. The outer tube 2 is surrounded by a refractory lining 4.

The dimensions of the double tube nozzles used in the experiment are shown in following Table 1,

TABLE 1

| | Nozzle dimensions | | | | | |
|---|---|---|---|---|---|---|
| | Inner tube | | | Outer tube | | |
| Nozzle no. | (a) (mm) | (b) (mm) | (c) (mm) | (a) (mm) | (b) (mm) | (c) (mm) |
| 1 | 15 | 21 | 3.0 | 23 | 29 | 3.0 |
| 2 | 15 | 21 | 3.0 | 23 | 27 | 2.0 |
| 3 | 15 | 21 | 3.0 | 24 | 27 | 1.5 |
| 4 | 15 | 21 | 3.0 | 25 | 29 | 2.0 |
| 5 | 23 | 29 | 3.0 | 31 | 35 | 2.0 |
| 6 | 23 | 29 | 3.0 | 31 | 37 | 3.0 |
| 7 | 23 | 29 | 3.0 | 33 | 37 | 2.0 |
| 8 | 6 | 10 | 2.0 | 12 | 16 | 2.0 |
| 9 | 6 | 9 | 1.5 | 11 | 14 | 1.5 |
| 10 | 6 | 9 | 1.5 | 13 | 17 | 2.0 |

(a) inner diameter;
(b) outer diameter; and
(c) wall thickness.

Figure 2:
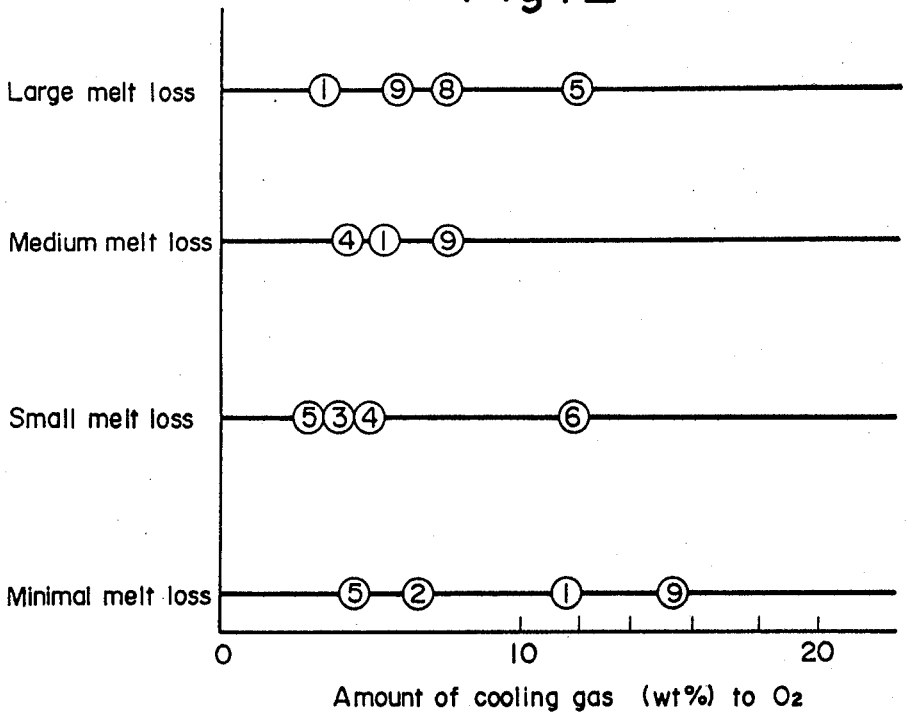
FIG. 2 is a chart showing the relation between the dimensions of the nozzle and the degree of nozzle melt loss when the blowing amount of a hydrocarbon gas is determined in accordance with the blowing amount of oxygen.

FIG. 2 shows the nozzle melt loss for various ratios of the cooling gas (propane) to the amount of the oxygen gas blown from the bottom of the refining vessel in the case of performing metal refining using the nozzles shown in Table 1 as the nozzle. The circled numerals in the figure are the nozzle numbers shown in Table 1.

As is clear from the results shown, depending on the dimensions of the nozzle, it is not always possible to obtain optimum results when using a hydrocarbon gas (propane) as the cooling gas by controlling the blowing amount of the cooling gas to less than 10% by weight of the blowing oxygen amount. Furthermore, in the case of using nozzles No. 1 and No. 9 shown in Table 1, the best result is obtained when the blowing amount of the hydrocarbon gas (propane) is larger than 10% by weight of the blowing oxygen amount. These facts show that simple control of the blowing amount of a cooling gas to an amount of less than 10% by weight of the blowing amount of oxygen is not always the best for protecting the nozzle.

Figure 3:
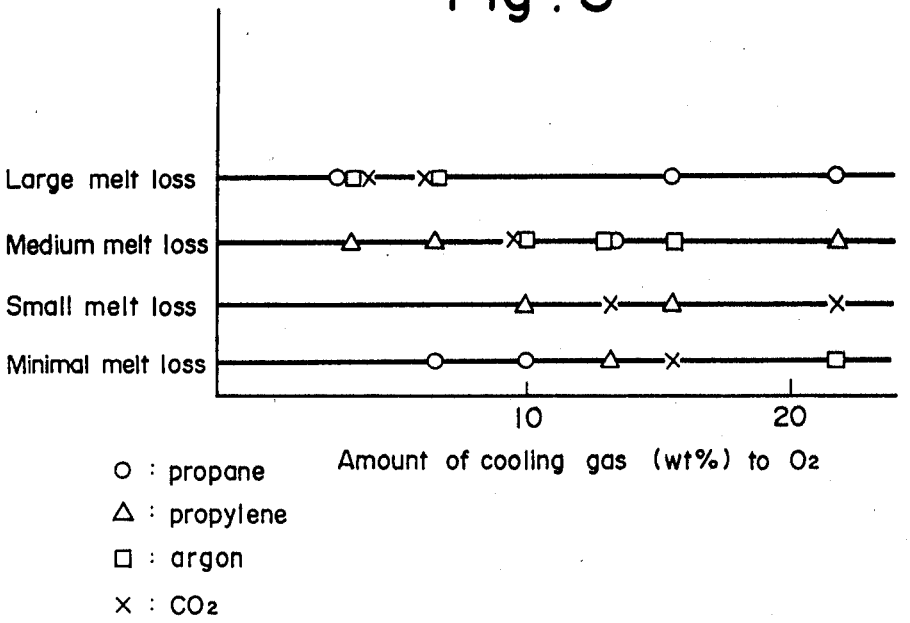
FIG. 3 is a chart showing the degree of nozzle melt loss when the kind and the flow rate of the cooling gas are changed while maintaining the dimensions of the nozzle constant.

On the other hand, the melt loss of the nozzle was investigated for various cooling gases, including carbon dioxide and argon, at various flow rates. The results obtained are shown in FIG. 3. From this figure, it is clear that the melt loss of the nozzle differs greatly with different kinds and/or flow rates of the cooling gas.

From these results, it is clear that sufficient nozzle cooling effect cannot be assured in metal refining simply by controlling the blowing amount of a cooling gas in accordance with the blowing amount of oxygen. The kind of the cooling gas and the dimensions of the nozzle used as the nozzle must also be considered in order to obtain a sufficient nozzle cooling effect.

Thus, for finding the relation between nozzle melt loss and the dimensions of the nozzle, the inventors evaluated the test results obtained by variously changing (1) the flow rate of the cooling gas and (2) dimensions of the nozzle, using propane or carbon dioxide gas as the cooling gas. The results obtained were evaluated with respect to the following value and it was discovered that sufficient protection of the nozzle can be realized by controlling the blowing amount of the cooling gas so as to maintain this value within a certain range:

$$\frac{B(Nl/\text{min.})}{\pi Di(\text{cm}) \times \Delta T(\text{cm})} = C(Nl/\text{cm}^2 \cdot \text{min.}) \qquad \text{II}$$

wherein, B is the flow rate of cooling gas per minute; $\pi$Di is the inside circumference of the outer tube (the outside circumference of the cooling gas passageway); $\Delta$T is the wall thickness of the outer tube; and C is the amount of the cooling gas to be supplied to the cooling gas passageway.

Figure 4:
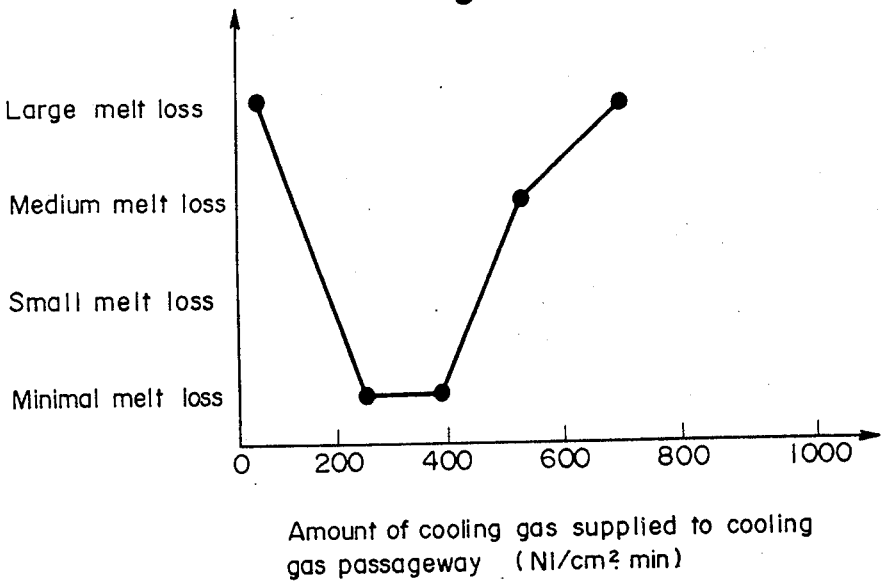
FIG. 4 is a graph showing the relation between the amount of cooling gas and the degree of nozzle melt loss in the case of using propane as the cooling gas.
Figure 5:
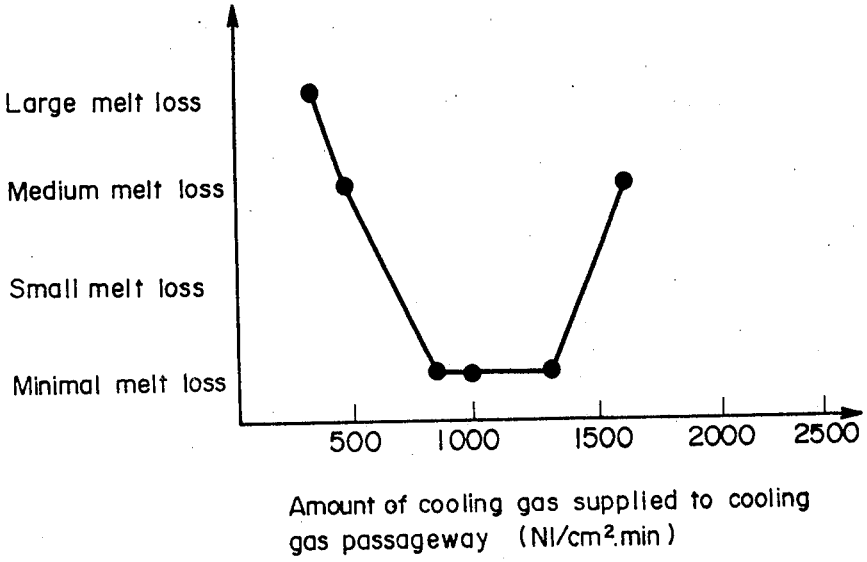
FIG. 5 is a graph showing the relation between the amount of cooling gas and the degree of nozzle melt loss in the case of using $CO_2$ as the cooling gas.

Moreover, it has been found that the above-described range differs according to the kind of cooling gas as shown in FIG. 4 and FIG. 5. More specifically, the range is 200–400 Nl/cm$^2$.min. for propane while it is 700–1300 Nl/cm$^2$.min. for $CO_2$.

The inventors assumed that the difference was caused by differences in the properties of the cooling gas, i.e., by differences in constant pressure specific heat and decomposition heat of the gases. In other words, they assumed that in the case of using a cooling gas showing less change in the amount of heat (change in amounts of sensible heat and latent heat) per Nl of the cooling gas (e.g., $CO_2$), it was necessary to increase the flow rate of the cooling gas as compared to the case of using a cooling gas showing a large change in the amount of heat (e.g., propane).

Figure 6:
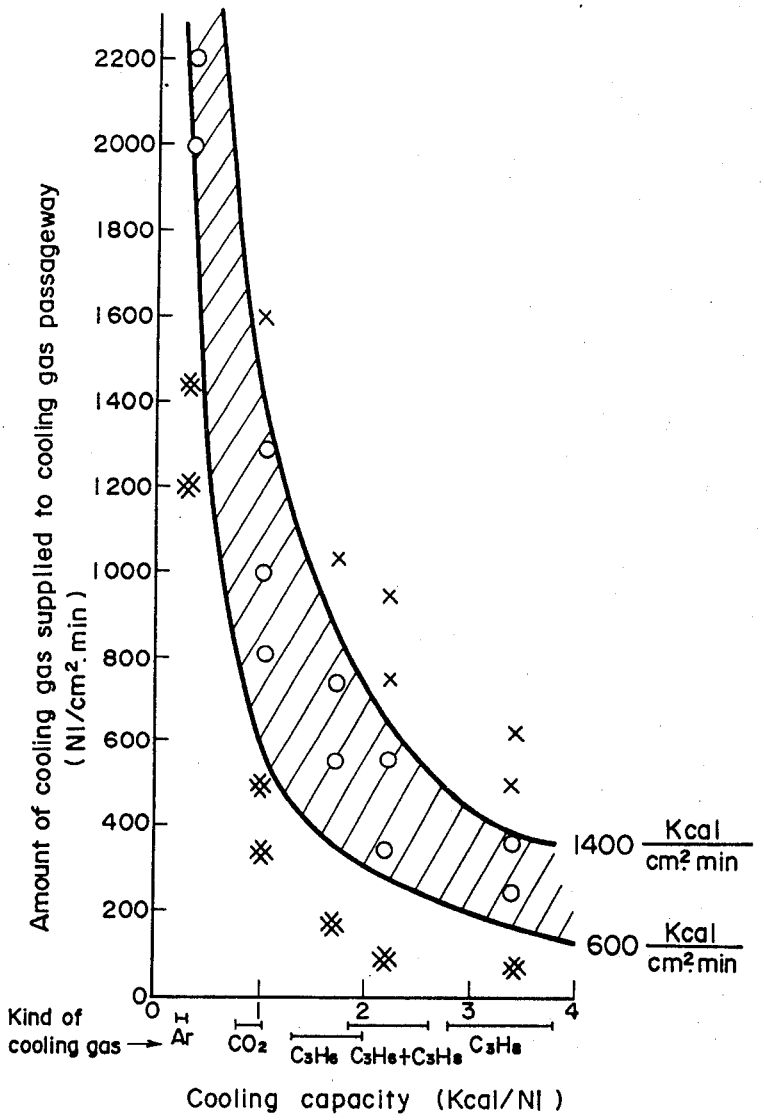
FIG. 6 is a graph showing the ranges of cooling gas flow rates usable in accordance with this invention in the case of various kinds of cooling gases having the cooling capacities shown.

Thus, various gases were tested and the change in the amount of heat per Nl thereof was defined as "the cooling capacity of the cooling gas." The relation between the cooling capacity of each cooling gas and the amount of the cooling gas is shown in FIG. 6 for all cooling gases used in the aforesaid test. As a result, it was found that (1) for a given cooling gas, there is a definite range of values of the foregoing ratio within which the occurrence of nozzle melt loss can be prevented and (2) these values are inversely proportional to the cooling capacity of the cooling gas. That is, in FIG. 6, the mark "O" shows that nozzle melt loss was very small, the mark "✱" shows the region in which nozzle melt loss was induced by insufficient cooling, and the mark "X" shows abnormal nozzle melt loss caused by the instability of the cooling gas stream because of excessive cooling.

Using the information shown in FIG. 6, the nozzle can be effectively protected regardless of the kind of cooling gas employed or the dimensions of the nozzle by controlling the flow rate of the cooling gas as defined by:

$$\frac{A(\text{Kcal}/Nl) \times B(Nl/\text{min.})}{\pi Di(\text{cm}) \times \Delta T(\text{cm})} = 600\text{–}1400(\text{Kcal/cm}^2 \cdot \text{min.})$$

wherein A, B, $\pi Di$, and $\Delta T$ have the same significance as defined in Equation I.

The invention will now be further explained with reference to the following examples.

EXAMPLE 1

Using a 100 ton converter equipped with 4 double tube nozzles having the following dimensions, molten steel was refined by blowing under the following conditions:

Dimensions of nozzle:
Inside diam. of inner tube: 15 mm,
Outside diam. of inner tube: 23 mm,
Inside diam. of outer tube: 25 mm,
Outside diam. of outer tube: 31 mm.
Amount of $O_2$ from the 4 inner tubes:
350 $Nm^3$/hr. per tube.
Flow rate of cooling gas (LPG) blown through 4 tubes:
33 $Nm^3$/hr. per tube.
Ratio of cooling gas to $O_2$ gas:
13% by weight.
Amount of cooling gas supplied to cooling gas passageway defined by the equation II:
233 $Nl/cm^2$.min.

As is clear from FIG. 4, under these conditions, the operation falls within the range of 1400–600 $Kcal/cm^2$.-min. and the melt loss of the nozzle was 1 mm/charge.

Comparison Example 1

Using a 100 ton converter equipped with 4 double tube nozzles having the following dimensions, a molten steel was refined by blowing under the following conditions:

Dimensions of the nozzle:
Inside diam. of inner tube: 16 mm,
Outside diam. of inner tube: 19 mm,
Inside diam. of outer tube: 20.8 mm,
Outside diam. of outer tube: 25.4 mm.
Amount of $O_2$ from 4 inner tubes:
567 $Nm^3$/hr. per tube.
Flow rate of cooling gas (LPG) blowing through 4 tubes:
40 $Nm^3$/hr. per tube.
Ratio of cooling gas to the $O_2$ gas:
9.7% by weight.
Amount of cooling gas supplied to the cooling gas passageway:
444 $Nl/cm^2$.min.

As is clear from FIG. 4, under these conditions, the operation was outside the range of 1400–600 $Kcal/cm^2$.-min. and the melt loss of the nozzle was 12 mm/charge.

EXAMPLE 2

The same procedure as in Example 1 was followed using the following 4 double tube nozzles and under the following conditions:

Dimensions of nozzle:
Inside diam. of inner tube: 15 mm,
Outside diam. of inner tube: 19 mm,
Inside diam. of outer tube: 25 mm,
Outside diam. of outer tube: 31 mm.
Amount of $O_2$ from 4 inner tubes:
350 $Nm^3$/hr. per tube.
Flow rate of cooling gas ($CO_2$) blowing through 4 tubes:
88 $Nm^3$/hr. per tube.
Ratio of cooling gas to the $O_2$ gas:
25% by weight.
Amount of cooling gas supplied to the cooling gas passageway:
1000 $Nl/cm^2$.min.

In this example, the melt loss of the nozzles was 0.8 mm/charge.

What is claimed is:

1. In a method of refining a metal by blowing a refining gas surrounded by a cooling gas into the melt of the metal to be refined using a concentric multi-tube system nozzle situated beneath the surface of the melt in a refining vessel, the improved metal refining method which comprises controlling the flow rate of the cooling gas passing through the passageway for the cooling gas formed between the outermost tube and the adjacent inner tube of the nozzle as defined by the following equation:

$$\frac{600 \times \pi Di \times \Delta T}{A} \leqq B \leqq \frac{1400 \times \pi Di \times \Delta T}{A}$$

wherein A is the cooling capacity of the cooling gas; B is the flow rate of the cooling gas; $\pi Di$ is the inside circumference of the outermost tube; and T is the wall thickness of the outermost tube.

2. The metal refining method as claimed in claim 1 wherein the concentric multi-tube system nozzle is a concentric double tube system nozzle.

3. The metal refining method as claimed in claim 1 wherein a hydrocarbon gas, carbon dioxide gas, carbon monoxide gas, or argon gas is used as the cooling gas.

4. The metal refining method as claimed in claim 3 wherein the hydrocarbon gas is propane gas or propylene gas.

5. The metal refining method as claimed in claim 1 wherein the refining gas is oxygen gas.

* * * * *